United States Patent [19]

Halvorsen

[11] Patent Number: 4,641,600

[45] Date of Patent: Feb. 10, 1987

[54] ROLLING BOAT COVER

[76] Inventor: Wilmet P. Halvorsen, Box #104, Frontenac, Minn. 55026

[21] Appl. No.: 853,512

[22] Filed: Apr. 18, 1986

[51] Int. Cl.[4] ..... B63B 17/00

[52] U.S. Cl. ..... 114/361; 114/202

[58] Field of Search ..... 114/361, 201 R, 201 A, 114/202, 203; 296/84 R, 98; 49/324, 349, 372, 404; 135/88, 96; 150/52 K; 160/238

[56] References Cited

U.S. PATENT DOCUMENTS

| | | | |
|---|---|---|---|
| 2,493,833 | 1/1950 | Reynolds | 114/361 |
| 2,639,751 | 5/1953 | Flaherty | 150/52 K |
| 3,077,225 | 2/1963 | Aavold | 114/202 |
| 3,222,102 | 12/1965 | Lucas | 150/52 K |
| 3,572,353 | 3/1971 | Pinkley | 114/361 |
| 3,898,947 | 8/1975 | Moore | 114/361 |
| 4,130,125 | 12/1978 | Nivin | 114/201 R |

FOREIGN PATENT DOCUMENTS

| | | | |
|---|---|---|---|
| 629920 | 10/1961 | Canada | 135/88 |
| 715355 | 8/1965 | Canada | 160/238 |
| 572383 | 1/1958 | Italy | 135/88 |

*Primary Examiner*—Galen Barefoot
*Assistant Examiner*—Stephen P. Avila
*Attorney, Agent, or Firm*—Henderson & Sturm

[57] ABSTRACT

The present invention provides an extendable and retractable cover for the cockpit of a small boat, especially for but not limited to boats of the recreational type. A cover sheet is rolled on to a roller that is disposed across the transom of the boat and may be unrolled to follow guides along the edges of the sides of the cockpit and to be latched to the top of the boat's windshield. Mechanism, preferably electrically operated, is provided for rolling and unrolling the sheet. The opposite edges of the sheet are reinforced by wear strips or beads that run in the guides. Cable and sheave or pulley devices are provided for rolling and unrolling the sheet. The structure may be provided as original equipment or as an after-market attachment.

7 Claims, 6 Drawing Figures

Fig. 4
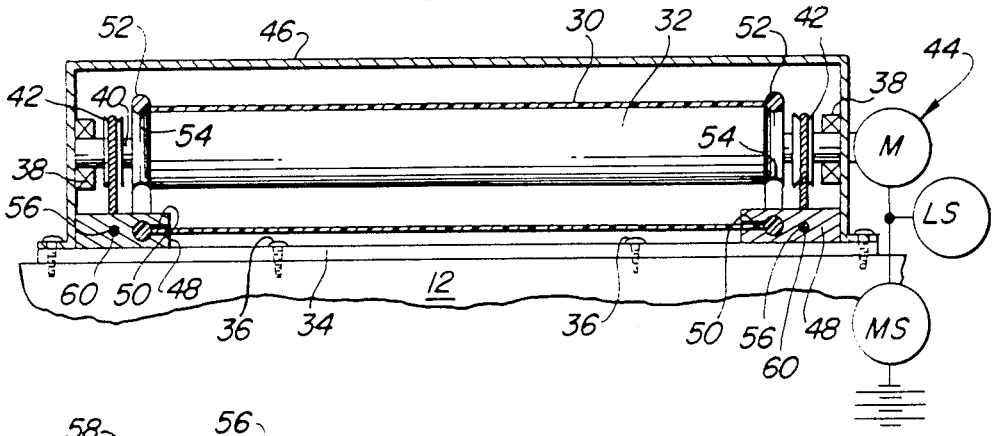
Fig. 5
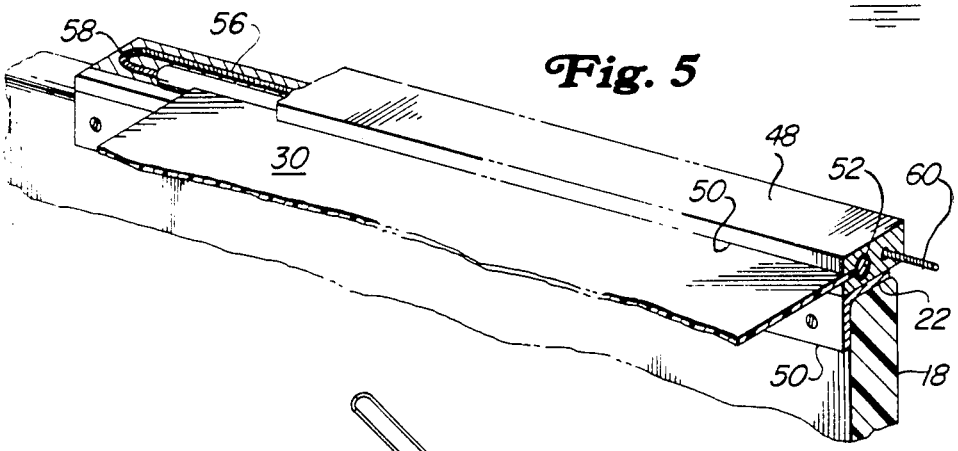
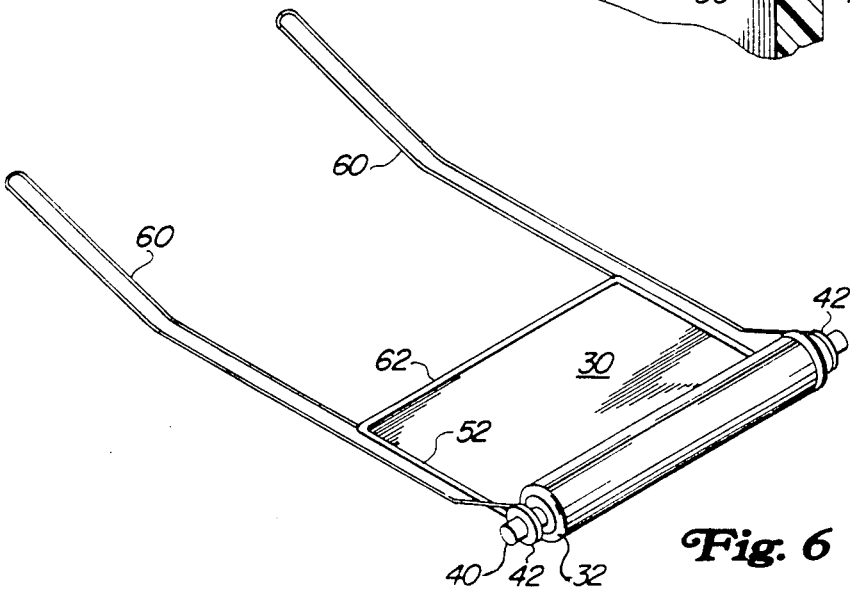
Fig. 6

ROLLING BOAT COVER

BACKGROUND AND SUMMARY OF THE INVENTION

Many forms of boat and like covers are known, some of which are simple, make-shift canvas or like covers and others of which are button-on, button-off types. Others may be manually rolled and unrolled. All these have various use and operational disadvantages, especially when attempted to be installed in windy conditions. According to the present invention, these disadvantages are eliminated by the provision of a cover construction that is compact and simple, that is easily attached to a boat and that is substantially foolproof in use and operation. The invention features guides or channels having means for the affixation thereof respectively to the fore-and-aft edges of the cockpit sides. The cover sheet is wound or wrapped on a powered roller that spans the guides and is suitably housed in a casing readily attachable to the transom of the cockpit. Improved control means is provided for effecting rolling and unrolling of the cover, including actuating means for starting and stopping the roller manually and for automatically stopping the unrolling operation when the cover has reached its intended covering status.

Further features will be pointed out as a preferred embodiment of the invention is disclosed in detail in the ensuing description and accompanying drawings.

DESCRIPTION OF THE DRAWINGS

FIG. 4 is an enlarged transverse section through the roller means.

FIG. 5 is a pictorial perspective illustrating portions of the guide means, cable means and associated portion of the cover sheet.

FIG. 6 is a schematic perspective of one form of cable and sheave mechanism.

DETAILED DESCRIPTION OF A PREFERRED EMBODIMENT OF AN INVENTION

Figure 1:
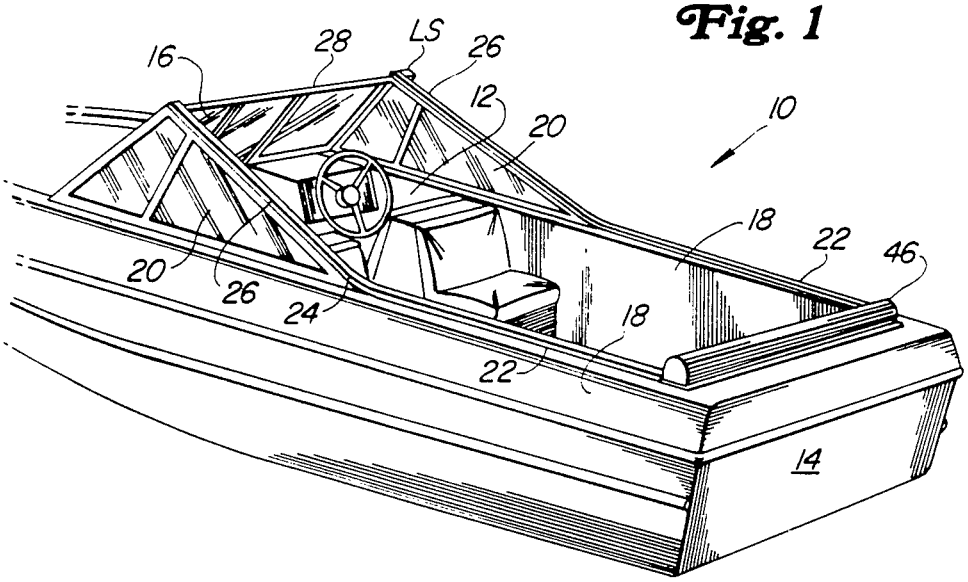
FIG. 1 is a perspective, with parts broken away, of a representative boat without the inventive cover construction.
Figure 2:
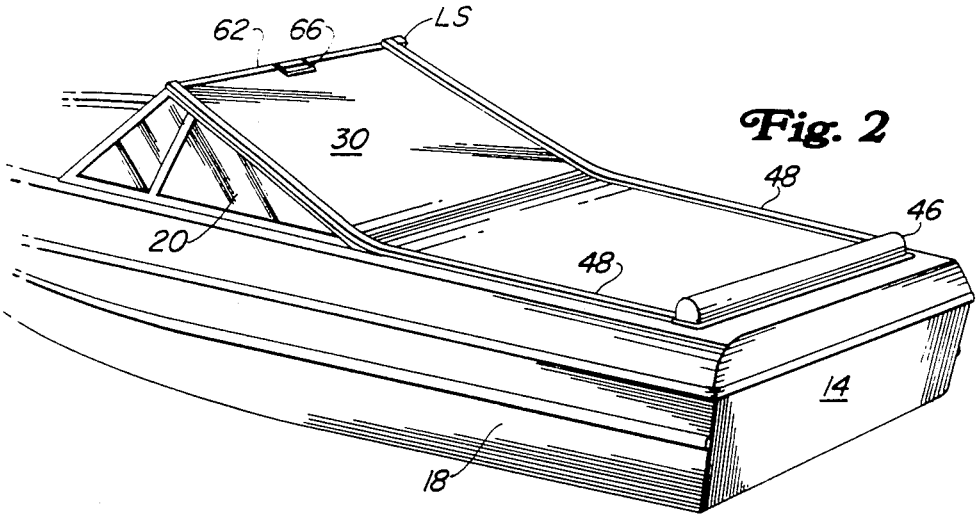
FIG. 2 is a similar view but showing the cover in place in covering mode.
Figure 3:
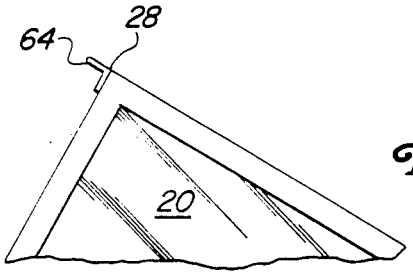
FIG. 3 is a fragmentary view showing one form of means for latching the cover to the top of the windshield.

A representative or typical boat is designated in its entirely by the numeral 10 as including a cockpit 12 delineated by a rear transom 14, a front windshield 16 and opposite sides 18. The windshield is of the type having side wings 20 and the sides 18 respectively have fore-and-aft top edges 22 contoured to follow along the sides and to slope upwardly and forwardly at 24 to follow the wing edges 26, the latter in effect forming continuations of the edges 22, respectively. The tops of the wings are cross-connected by a frame member 28 that forms the top of the windshield. The windshield and the wings are typically glazed in any suitable fashion. Thus the cockpit is mainly open from above and, if not covered, is subject to the ravages of the weather. The present invention provides a protective cover for the cockpit when the boat is not in use.

Fundamentally, the cover construction comprises a cover sheet 30 of flexible, weather-proof material capable of being rolled on and unrolled from a transom-carried roller 32 to selectively occupy open and closed modes as respects the cockpit. The roller is mounted on the transom by means of a cross member 34 having suitable means such as screws 36 capable of being screwed into the top edge of the transom. It is also contemplated that appropriate adhesive means (not shown) may be used. The member 34 has transversely spaced apart bearings 38 which journal a shaft 40 keyed or otherwise fixed to the roller and having keyed to opposite end portions pulleys or sheaves 42. The roller shaft may be extended at one end for connection to power means 44, here represented by an electric motor M and an electrical circuit including a main on-off switch MS and at least one limit switch LS, the details of which may of course be varied once the principle is disclosed, as here. The whole may be enclosed in a removable housing 46 which may have a snap-on, snap-off connection to the member 34, again a detail that may be satisfied in many ways. For reasons that will presently appear, the housing has a forward transverse slot (not shown) for accommodating extension and retraction of the sheet 30.

A further aspect of the cover construction is a pair of fore-and-aft guides 48 that extend respectively along and follow the contours of the cockpit side edges 22-24-26. Each guide has means for the affixation thereof to its edges. A representative form of means 50 is shown as including a flange and suitable screws. Again, it is contemplated that adhesive means may be used. Each guide, although shown as straight in FIG. 5 for clarity, is configured to follow the sides edges as explained above. Each guide further has a channel 50 opening laterally inwardly and toward the opposite guides. This channel is so shaped as to accommodate a fore-and-aft reenforcing bead 52 on the proximate marginal portion of the sheet, it being understood that both edges of the sheet are similarly stiffened or beaded. The ends of the roller are reduced at 54 to accommodate the beads (FIG. 4).

In addition to the channel, each guide includes a fore-and-aft conduit or passage 56 paralleling the channel 50 and communicated with its channel at the forward end of the guide by a U-shaped part 58. At each side of the structure, a flexible line 60 of suitable strength and material (e.g. nylon cord) is attached at one end to a cross bead 62 at the front of the sheet 30 and extends through the channel 56 and "turns the corner" at 58 and returns for affixation to its associated sheave 42 (FIG. 6). Thus, when the motor is operated to run the shaft 42 counterclockwise as seen in FIG. 6, the lines or cables are wound on their respective sheaves to draw the sheet 30 forwardly and uphill until the cross bead reaches the top of the windshield, where it is stopped by the limit switch LS. Conversely, when the motor is reversed, the sheet is rolled back onto the roller. A second limit switch (not shown) may be provided to stop the sheet in its rolled up status or the manual switch may be relied on for this purpose. The cover, when extended, may be suitably latched to the windshield as suggested at 64. A handle may be provided at 66 for operating the cover manually. Appropriate seals should be provided at junctions apt to take in moisture, etc., the details of which may be varied and hence not illustrated. Also, wiper means, also not shown, could be provided at the roller housing where the cover enters and exits, again involving details of no patentable significance per se. Features and advantages not specifically pointed out herein will become apparent to those versed in the art, as will many modifications in the preferred embodiment disclosed, all without departure from the spirit and scope of the invention.

I claim:

1. For a boat having a cockpit delineated by opposite fore-and-aft sides, a rear transom and a transverse front windshield wherein the sides respectively have upper edges extending substantially forwardly from the transom and thence sloping upwardly to and meeting the top of the windshield: a cover construction for enclosing the cockpit, comprising a pair of elongated guides fashioned to extend respectively continuous along the side edges from the transom to the top of the windshield and including means for affixation to the edges, a roller spanning the channels at the transom, a flexible cover sheet wrapped on the roller and having opposite fore-and-aft marginal portions received respectively in the guides, the sheet having a transverse front edge and being of such length that, when unrolled, it extends from the roller to dispose its front edge at the top of the windshield, means for rolling and unrolling the sheet, and means for attaching the front edge of the sheet to the top of the windshield.

2. The cover construction of claim 1, including power means for turning the roller to roll and unroll the sheet.

3. The cover construction of claim 2, including cable and pulley means associated with the roller for rolling and unrolling the sheet.

4. The cover construction of claim 2, in which the power means includes an electric motor and an electric circuit having a manual start-stop switch and automatic limit switch means to stop the motor at the end of the unrolled status of the sheet.

5. The cover construction of claim 1, in which the marginal portions of the sheet respectively have fore-and-aft reenforcing beads thereon and received respectively in the guides.

6. The cover construction of claim 5, in which each guide is a channel having a fore-and-aft opening slot facing transversely inwardly to the other guide.

7. The cover construction of claim 5, including cable and pulley means for rolling and unrolling the sheet, and each guide further including a fore-and-aft conduit housing the respective cable.

* * * * *